US007361106B1

(12) United States Patent
Vacek et al.

(10) Patent No.: US 7,361,106 B1
(45) **Date of Patent: *Apr. 22, 2008**

(54) BAT HAVING A SLEEVE WITH SLOTS

(75) Inventors: Matthew V. Vacek, Brownsville, MN (US); Buji Mathew, La Crosse, MI (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/553,360

(22) Filed: Oct. 26, 2006

Related U.S. Application Data

(63) Continuation of application No. 11/244,638, filed on Oct. 6, 2005, now Pat. No. 7,214,152, which is a continuation-in-part of application No. 11/135,315, filed on May 23, 2005.

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 59,313 | A * | 10/1866 | Hill | 473/564 |
| 729,639 | A * | 6/1903 | McCoy | 473/520 |
| 2,340,156 | A | 1/1944 | Taylor et al. | |
| 3,236,104 | A | 2/1966 | Pape | |
| 3,479,030 | A | 11/1969 | Merola | |
| 3,691,625 | A | 9/1972 | Swenck | |
| 3,697,069 | A | 10/1972 | Merola | |
| 3,735,463 | A | 5/1973 | Merola | |
| 3,841,130 | A | 10/1974 | Scott, Jr. et al. | |

(Continued)

FOREIGN PATENT DOCUMENTS

| | | | |
|---|---|---|---|
| JP | 01110379 | A | 4/1989 |

(Continued)

OTHER PUBLICATIONS

At least as early as 2002, Miken Sports sold its Ultra2 Softball Bat that had a composite sleeve that was thick in the middle and thin at either edge.

*Primary Examiner*—Mark S Graham
(74) *Attorney, Agent, or Firm*—Waddey & Patterson, P.C.; Phillip E. Walker

(57) ABSTRACT

Disclosed herein is a bat comprising a handle portion, a transition portion attached to the handle portion, and a barrel portion attached to the transition portion. The barrel portion includes one or more first cross-sections having a first stiffness and a plurality of second cross-sections having a second stiffness. Each first cross-section is beside one second cross-section or between two of the second cross-sections and the first stiffness is greater than the second stiffness. The variance in stiffness between the first cross-sections and the second cross-sections is created by varying the amount of material in the cross-section or by, more accurately, removing material in the second cross sections to make the second cross-sections more flexible by creating slots. Likewise, a bat may be provided with third cross sections on the sides of the second cross-sections distal from the first cross-section whereby the third cross-sections are less stiff that the second cross-sections because more material is removed.

18 Claims, 3 Drawing Sheets

U.S. PATENT DOCUMENTS 3,854,316 A 12/1974 Wilson
3,990,699 A 11/1976 Urmston
4,025,377 A 5/1977 Tanikawa
4,036,044 A 7/1977 Yoshimura
4,089,199 A 5/1978 Siemonsen
4,186,923 A * 2/1980 Garner et al. ..... 473/565
4,331,330 A 5/1982 Worst
4,569,521 A 2/1986 Mueller
4,600,193 A 7/1986 Merritt
4,930,772 A 6/1990 Malony et al.
5,094,453 A * 3/1992 Douglas et al. ..... 473/566
5,131,651 A 7/1992 You
5,150,897 A * 9/1992 Wortman ..... 473/567
5,364,095 A 11/1994 Easton et al.
5,415,398 A 5/1995 Eggiman
5,511,777 A 4/1996 McNeely
5,899,823 A * 5/1999 Eggiman ..... 473/566
5,961,405 A * 10/1999 MacKay, Jr. ..... 473/566
5,964,673 A * 10/1999 MacKay, Jr. ..... 473/566
6,022,282 A 2/2000 Kennedy et al.
6,048,283 A * 4/2000 Albarelli, Jr. ..... 473/567
6,146,291 A 11/2000 Nydigger
6,176,795 B1 1/2001 Schullstrom
6,344,007 B1 2/2002 Feeney et al.
6,425,836 B1 * 7/2002 Misono et al. ..... 473/567
6,440,017 B1 8/2002 Anderson
6,497,631 B1 12/2002 Fritzke et al.
6,612,945 B1 9/2003 Anderson
6,733,404 B2 5/2004 Fritzke et al.
6,761,653 B1 7/2004 Higginbotham et al.
6,776,735 B1 * 8/2004 Belanger et al. ..... 473/567
6,949,038 B2 * 9/2005 Fritzke ..... 473/566
6,969,330 B1 * 11/2005 Meeker ..... 473/567
2001/0034277 A1 * 10/2001 Haringa ..... 473/457
2002/0016230 A1 2/2002 Okuyama et al.
2002/0091022 A1 * 7/2002 Fritzke et al. ..... 473/566
2002/0094892 A1 * 7/2002 Chauvin et al. ..... 473/566
2003/0224883 A1 * 12/2003 Liberatore ..... 473/457
2004/0152545 A1 8/2004 Fritzke
2004/0194521 A1 * 10/2004 Andrews ..... 72/53
2005/0070384 A1 * 3/2005 Fitzgerald et al. ..... 473/567

FOREIGN PATENT DOCUMENTS

JP 09299526 A * 11/1997
JP 102489789 A 9/1998
JP 11137752 A * 5/1999
JP 2003038697 A * 2/2003

* cited by examiner

BAT HAVING A SLEEVE WITH SLOTS

This is a continuation application claiming priority based upon co-pending U.S. patent application Ser. No. 11/244,638 filed Oct. 6, 2005 entitled "Bat Having A Sleeve With Slots", which is a continuation-in-part application claiming priority based upon U.S. patent application Ser. No. 11/135,315 filed May 23, 2005 entitled "Bat with Enlarged Sweet Spot", both of which are hereby incorporated by reference in their entireties.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications discussed herein are hereby incorporated by reference in their entirety.

BACKGROUND OF THE INVENTION

The present invention relates generally to baseball and softball bats. More particularly, the invention relates to a bat having a sleeve with slots.

It can be appreciated that numerous attempts have been made to improve the performance of a bat. These prior attempts have included the addition of various shells, inserts, materials, and shapes of the bat in order to improve its performance or usage. For example, U.S. Pat. Nos. 6,733,404, 6,497,631, 6,176,795, 6,022,282, 4,930,772, 4,331,330, and 3,990,699, and U.S. Patent Application Publication No. 2002/0016230 disclose various attempts to improve the performance or use of a bat.

The performance of a bat is generally based upon the weight of the bat, size of the bat, and the impact response of the bat at and during impact with a ball. Most of the focus for improvements in bat technology has been in improving the performance of the preferred impact area, or sweet spot. As the prior art bats have increased the performance in this area, many of the sports regulatory agencies have placed performance and/or configuration restrictions on the bats. These restrictions have mandated new innovations in the development of the bat technology.

For example, one regulatory body requires a maximum performance from a bat when impacted in the preferred impact area or sweet spot of the bat. Typically, this location is approximately six inches from the end of the bat. As such, the current maximum performance for the bat in its preferred hitting area is limited by these regulations. However, it is also to be understood that the area to either side of the sweet spot on a prior art bat has a significant drop off in performance.

The contemporary bat art has made few attempts to improve the performance of the bat sections adjacent the preferred impact area. As such, the performance of the bats in areas distal from, and even adjacent to, the sweet spot dramatically drops for the conventional bats. However, these attempts have drawback.

For example, U.S. Patent Application Publication 2004/0152545 discloses increasing the thickness over the sweet spot of the barrel in order to increase the leaf spring effect of the bat. However, this patent application publication fails to reduce the thickness of any wall within the bat in order to increase performance of the bat. As such, this patent application publication increases the weight of the bat in an attempt to increase the performance of the bat, which is counter productive. This patent application publication also increases the cost of the bat by increasing the amount of material used. Additionally, when there is a portion of a bat that has a change in diameter, that portion becomes a weakened spot. Additionally, the differences in spacing between portions of the body and of the frame can create weaknesses. Further, the differences in distance between the body and frame can cause manufacturing issues as to how to fill the variable distances and how to maintain the variable distances during construction of the bat. Further, this published application discloses placing slots in one end of the bat to reduce the diameter of that end of the insert to more easily place an insert into a bat frame but fails to understand the benefits of placing the slots in both end of the sleeve as to increasing the flexibility of the bat hitting portion beyond the center of the barrel. Further, the slots are not sufficient in length to increase the size of the sweet spot.

Thus, there is a continuing need for improved overall performance of bats. These improved bats need to conform to the regulatory agencies' restrictions in the preferred hitting zone while performing well beyond the preferred hitting zone. This needed bat should increase the stiffness in the preferred hitting zone as compared to the area(s) adjacent the preferred hitting zone. This needed bat must not have inconsistent spaces between the sleeve and the hitting portion. As such, what is needed is a bat that varies the stiffness of the wall of the bat in order to enhance performance of the bat.

BRIEF SUMMARY OF THE INVENTION

Disclosed herein is a bat comprising a handle portion, a transition portion attached to the handle portion, and a barrel portion attached to the transition portion. The barrel portion includes one or more first cross-sections having a first stiffness and a plurality of second cross-sections having a second stiffness. Each first cross-section is beside one second cross-section or between two of the second cross-sections and the first stiffness is greater than the second stiffness. The variance in stiffness between the first cross-sections and the second cross-sections is created by varying the amount of material in the cross-section or by, more accurately, removing material in the second cross sections to make the second cross-sections more flexible by creating slots. Likewise, a bat may be provided with third cross sections on the sides of the second cross-sections distal from the first cross-section whereby the third cross-sections are less stiff than the second cross-sections because more material is removed. Spacers may be added to slots to prevent rough surfaces and gaps.

It is therefore a general object of the present invention to provide a bat having variable wall stiffness.

Still another object of the present invention is to provide a bat having varying amounts of materials in different cross sections of the bat.

Yet still another object of the present invention is to enlarge the effective preferred hitting area of the bat.

Another object of the present invention is to provide a bat having an enlarged sweet spot.

Yet still another object of the present invention is to increase the length of the barrel/sweet spot without adding additional weight to the bat.

Yet another object of the present invention is to decrease the wall stiffness on either or both sides of the main hitting area.

And yet another object of the present invention is to provide a bat that increases the performance of the bat in sections of the bat adjacent to the main hitting area.

Yet another object of the present invention is to provide a bat which meets regulatory standards in the preferred hitting area as well as the areas adjacent to it.

Yet another object of the present invention is to provide material that can be placed in the slots to prevent rough surfaces and/or to prevent gaps.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
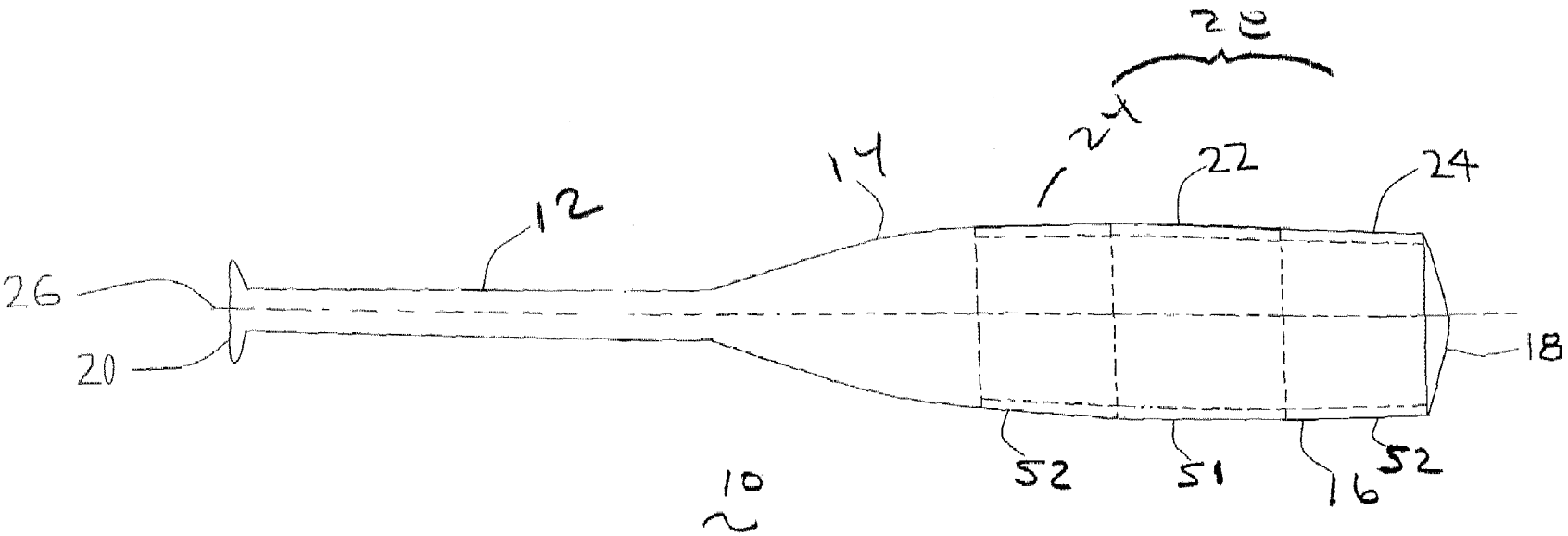
FIG. 1 is a side view of a bat made in accordance with the current disclosure.
Figure 3:
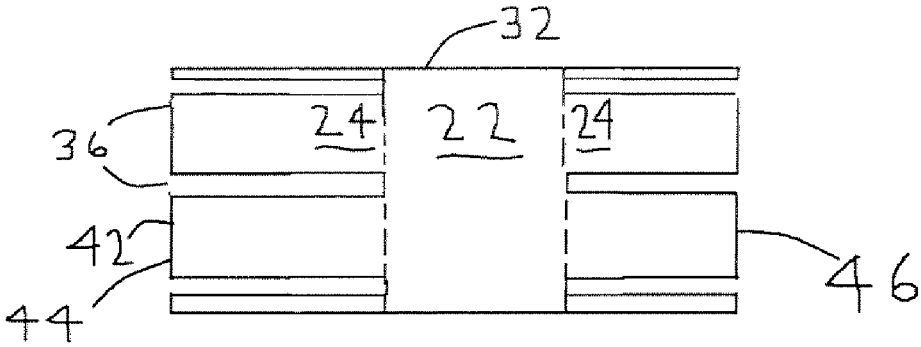
FIG. 3 is a side view of yet another embodiment of the sleeve of the present invention.

Referring generally now to FIGS. 1 and 3, there is shown generally at 10 one embodiment of the bat of the present invention. The bat 10 comprises a handle portion 12, a transition portion or taper portion 14, and a barrel portion 16. The transition portion 14 is preferably attached to the handle portion 12, while the barrel portion 16 is attached to the transition portion 14. An end cap 18 is traditionally placed on the end of the barrel portion 16 distal from the taper 14. A knob 20 is traditionally attached to the handle 12 on the end of the handle 12 distal from the barrel portion 16. Each bat has a preferred hitting section 28 that can also be called the sweet spot. In a traditional bat, the preferred hitting portion 28 lies in the middle portion of the barrel portion. For the purposes of this application, the area proximal the central part of the barrel portion 16 is the first cross-section 22. The area on either or both sides of the barrel portion will be called the second cross-section 24.

One focus of the present invention is to make the first cross-section 22 stiffer than the second cross-sections 24. By doing this, the first cross-section 22, because it is the center of percussion will continue to be the best performing portion of the bat. However, by making the second cross-sections 24 more flexible, the sweet spot will extend well into the second cross sections 24 as opposed to remaining virtually exclusively in the first cross-section 22.

Referring now to FIG. 3, there is shown generally at 32 an embodiment of the sleeve of the present invention. In this embodiment, material is removed from the second cross-section 24 in the form of slots 36. In this embodiment, slots run axially along the length of the sleeve 32 from each of a taper end 44 and a distal end 46. In this embodiment, the slots 36 are of a substantially similar length to create flaps 42 between the slots 36. In this embodiment, the slots 36 run substantially from either end 44, 46 to the first cross-section 22 or, stated another way, along the length of the second cross-section 24. The mere fact that the slots 36 remove material from the sleeve 32 causes the sleeve 32 to be much more flexible in hoop stiffness in the second cross-section where the slots 36 are removed as compared to the first cross-section 22 where little or no material has been removed. Additionally, the creation of the flaps 42 means that the flaps can bend inwardly not only in the direction of hoop strength but also as a lever proximal to either end 44, 46.

Figure 2:
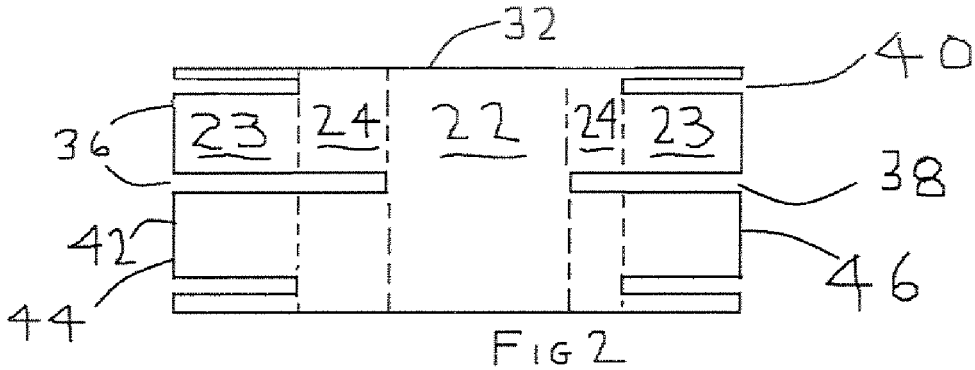
FIG. 2 is a side view of one embodiment of a sleeve of the present invention.

The sleeve portion 32 of a second embodiment of the present invention is shown in FIG. 2. The sleeve 32 has a series of slots 36 running axially along the length of the sleeve 32. The slots 36, in turn, create flaps 42. Although the slots 36 may be of substantially consistent length as shown in FIG. 3, in the embodiment of FIG. 2, slots 36 have different lengths thereby having first slots 38 and shorter second slots 40. If the slots 36 have similar lengths, the slots 36 and corresponding flaps 42 created by the slots 36 create second cross-sections 24 that are more flexible than the first cross-section 22 by both removing material in the slots 36 and by making the flaps 42 able to flex inwardly. If slots 36 are of variable lengths to create slots 38, 40, third cross sections 23 are created on the sides of the second cross-sections 24 distal from the first cross-section 22 because more material is removed from the third cross-sections 23 than the second cross-sections 24 and flaps 42 will necessary be more flexible distal from the first cross-section 22. For a point of reference only, and not necessarily as a functional reference, sleeve 32 has a taper end 44 that is preferably aligned proximal to or along the taper portion 14 of the bat 10 and a distal end 46 that is preferably aligned proximal to or attached to the end cap 18 of the bat 10. Thus, in the preferred embodiment, slots 36 run axially along the sleeve 32 from either the taper end 44 or the distal end 46 toward the first cross-section 22. Likewise, the flaps 42 will be more flexible at the taper end 44 or the distal end 46 than proximal to the first cross-section 22.

Figure 4:
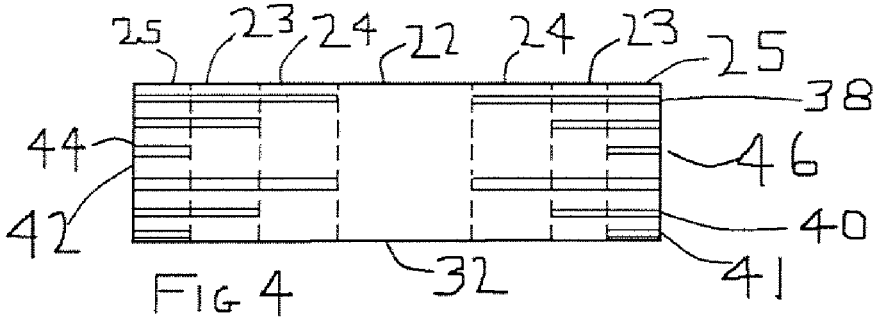
FIG. 4 is a side view of yet another embodiment of the sleeve of the present invention.

Referring now to FIG. 4, there is shown generally at 32 another embodiment of the sleeve of the present invention. In this embodiment, material is removed from the second cross-sections 24, the third cross-sections 23, and fourth cross-sections 25 located on either side of the sleeve 32 adjacent to third cross-section distal from the second cross-section in the form of first slots 38, second slots 40 (shorter than first slots 38), and third slots 41 (shorter than second slots 40). Thus, the fourth cross-sections 25 have a stiffness S4 that is less than the third cross-sections 23 which have a stiffness S3 which is less than the second cross sections 24 which has a stiffness S2 less than the stiffness S1 of the first cross-section 22. Although this embodiment shows the slots 36 being in order of length, any order may be used.

Figure 5:
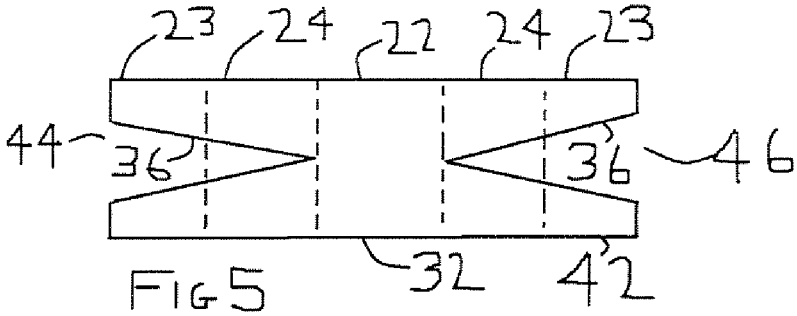
FIG. 5 is a side view of yet another embodiment of the sleeve of the present invention.

FIG. 5 is a variation on the theme combining the techniques of the other embodiments. In this embodiment, slots 36 are wide proximal the ends 44, 46 and narrower proximal the first cross-section 22. As a result, more material is removed from the third cross-section 23 than from the second cross-section 22 that have more material removed than the first cross section. As a result, the first cross-section 22 is stiffer than the second cross-section 24 which is stiffer than the third cross-section 23. As was true with the embodiment shown in FIG. 2, the slots 36 create flaps 42 which are flexible at the ends 44, 46. In the orientation shown in FIG.

5, the width of the slot 36 is wider at either end 44, 46 than proximal the second cross-section 24 which is wider than proximal the first cross-section 22.

Figure 6:
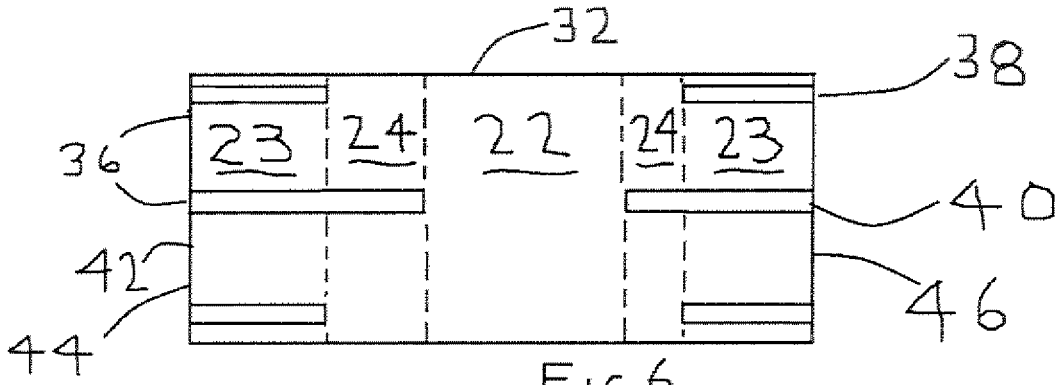
FIG. 6 is a side view of yet another embodiment of the sleeve of the present invention.
Figure 7A:
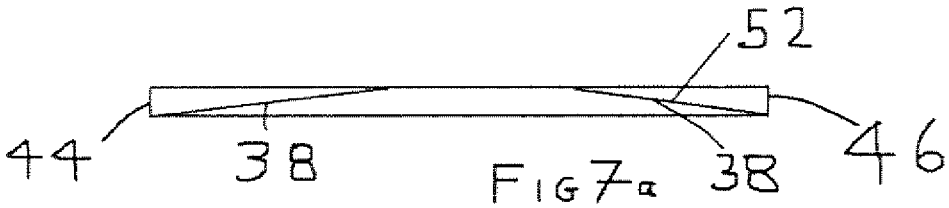
FIGS. 7*a* and 7*b* are cutaway views showing the slots in FIG. 6.
Figure 7B:
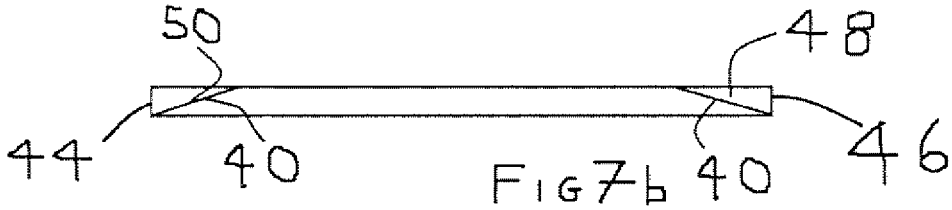

It should be understood that although FIGS. 2-5 show embodiments in which all of the material is removed from the respective slots 36, material may be left in by merely thinning the wall of the sleeve 32 at those points. FIGS. 6-7 shows such an embodiment. In this embodiment, slots 36 are merely thinner portions of the sleeve 32. However, the depth of the slot, 40 in this instance, is greater at the ends 44, 46 and less proximal to the first cross-section 22. The same variations in depth from the ends 44, 46 can be used for the other shapes shown in FIGS. 2-5. By removing more material proximal to the ends 44, 46, the sleeve 32 is more flexible proximal to the ends 44, 46. In the preferred embodiment, material is removed gradually from the ends 44, 46 to the termination of the respective slot 36, 38, or 40 as shown in FIGS. 7*a* and 7*b*.

Likewise, we refer to the sleeve 32 as being either a shell or an insert.

Figure 8:
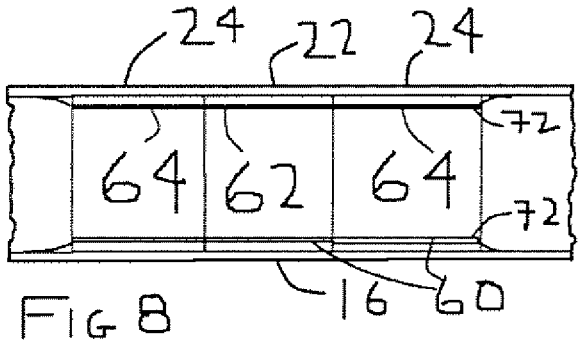
FIG. 8 is a side view of yet another embodiment of the sleeve of the present invention.

FIG. 8 shows yet another embodiment of the present invention. In this embodiment, the sleeve 32 is made of at least two and preferably three rings. The first ring or material 62 located adjacent second ring or material(s) 64. The first ring 62 is placed within the barrel portion 16 proximal to the first cross-section 22. The second ring 64 is placed within the barrel portion 16 on either or both sides of the first ring 62 to lie within either or both second cross-sections 24. The first ring 62 is stiffer than the second ring 64 thereby making the stiffness S1 of the first cross-section 22 greater than the stiffness S2 of the second cross-section 24. The rings 62 and 64 may be joined together. Also, an envelope 72 may be provided to join at its end to the sleeve 62 to hold the rings 62 and 64 in place. The slots described herein can be placed in any of the rings 60 as necessary to make the second cross-sections 24 more flexible than the first cross-section 22.

In the preferred embodiments, the sleeve 32 and the shell 30 are force or press fit over each other. However, some adhesive can be used in addition to the envelope discussed above.

In the preferred embodiment of FIG. 3, the barrel is substantially 12.00 inches long, the first cross-section is substantially 2.00 inches long, and each second cross-section is substantially 5.00 inches long.

In the preferred embodiment of FIG. 2, the barrel is substantially 12.00 inches long, the first cross-section is substantially 2.00 inches long, each second cross-section is substantially 1.00 inches long, and each third cross-section is substantially 4.00 inches long.

In the preferred embodiment of FIG. 4, the barrel is substantially 12.00 inches long, the first cross-section is substantially 2.00 inches long, each second cross-section is substantially 2.00 inches long, each third cross-section is substantially 2.00 inches long, and each fourth cross-section is substantially 1.00 inches long.

It should also be understood that sleeve 32 may be secured to barrel 16 along its entire length or only over a portion. For example, the first cross-section 22 could be secured to the barrel 16 leaving the second cross-section 24 to move independently.

It should be understood that bat 10 and sleeve 32 may be constructed from any material including metal, alloys, rubber, and composites. The preferred material for the frame is composite material while the preferred material for the sleeve is some type of metal such as aluminum or titanium. In the preferred embodiment, slots are made by cutting with a router or saw although a laser may be used.

It should be understood that slots 36 may be filled in with a spacer material (48 in FIG. 7*b*) that either does not affect the flexibility created by the slots or affects it very minimally. This spacer material 7*b* may be rubber or a powder metal that provides little if any stiffness but prevents the outer or inner surface of the sleeve 32 from having rough surfaces and prevents gapes between the sleeve 32 and the barrel portion 16.

Thus, although there have been described particular embodiments of the present invention of a new and useful Bat with a Sleeve Having Slots, it is not intended that such references be construed as limitations upon the scope of this invention except as set forth in the following claims.

What is claimed is:

1. A bat having a sleeve having a taper end and a distal end, the sleeve comprising:

a first cross-section and a pair of second cross-sections adjacent to each end of the first cross section, the sleeve having first slots running axially along the length of each of the second cross sections but terminating proximal to the first cross-section each first slot circumferentially spaced from adjacent first slots, wherein a single piece of material comprises the first and second cross sections.

2. The bat of claim 1 wherein the sleeve further comprises a third cross-section on the side of each of the second cross-sections distal from the first cross section, the sleeve having second slots running axially along the length of each of the third cross sections but terminating proximal to the respective adjacent second cross-section.

3. The bat of claim 2 wherein the sleeve further comprises a fourth cross-section on the side of each of the third cross-sections distal from the first cross section, the sleeve having third slots running axially along the length of each of the fourth cross sections but terminating proximal to the respective adjacent third cross-section.

4. The bat of claim 1 wherein at least one of the first slots is wider at the ends than proximal the first cross section.

5. The bat of claim 1 wherein at least one of the first slots decreases in depth from the ends to the first cross section.

6. The bat of claim 1 further comprising the first cross-section being a first ring and the second cross-sections being second rings.

7. The bat of claim 6 further comprising an envelope for holding the sleeve proximal the barrel portion.

8. The bat of claim 1 wherein the first cross-section is attached to the bat but the second cross-section is not.

9. The bat of claim 1 wherein the first cross-section is adhered to the bat but the second cross-section is not.

10. The bat of claim 1 wherein the sleeve further comprises flaps between the slots.

11. A bat having a barrel portion and a sleeve, the sleeve comprising:

a first cross-section;

a second cross-section on each side of the first cross section, each second cross-section having first slots and flaps; and wherein the slots are circumferentially separated by the flaps.

12. The bat of claim 11 wherein the sleeve further comprises a third cross-section adjacent to each of the second cross-sections distal from first cross-section, each the third cross-section having second slots shorter than the first slots.

13. The bat of claim 12 wherein the sleeve further comprises a fourth cross-section adjacent to each of the third cross-sections distal from second cross-sections, each the fourth cross-section having third slots shorter than the second slots.

14. The bat of claim 11 wherein the first slots are wider distal from the first cross-section and narrower proximal the first cross-section.

15. The bat of claim 11 wherein the depth of the first slots is greater proximal the first cross-section than distal the first cross-section.

16. The bat of claim 11 further comprising a spacer for filling at least one of the slots.

17. The bat of claim 4 wherein the first and second slots are wider at the ends than proximal the first cross section.

18. The bat of claim 5 wherein the first and second slots decrease in depth from the ends to the first cross section.

* * * * *